US008162204B2

(12) United States Patent
Makofsky

(10) Patent No.: US 8,162,204 B2
(45) Date of Patent: Apr. 24, 2012

(54) POCKET FOLDER AND BLANK FOR MAKING SAME

(75) Inventor: Marvin A. Makofsky, Sands Point, NY (US)

(73) Assignee: Conformer Products, Inc., Great Neck, NY (US)

( * ) Notice: Subject to any disclaimer, the term of this patent is extended or adjusted under 35 U.S.C. 154(b) by 1384 days.

(21) Appl. No.: 11/395,496

(22) Filed: Mar. 31, 2006

(65) Prior Publication Data

US 2007/0228118 A1 Oct. 4, 2007

(51) Int. Cl.
*B65D 27/00* (2006.01)
*B42F 7/02* (2006.01)

(52) U.S. Cl. ..... 229/67.3; 229/67.1; 229/928

(58) Field of Classification Search ..... 229/67.1, 229/67.3, 928, 67.4, 72
See application file for complete search history.

(56) References Cited

U.S. PATENT DOCUMENTS

| | | | | | |
|---|---|---|---|---|---|
| 3,860,164 | A * | 1/1975 | Dworkin | 383/122 |
| 5,398,866 | A * | 3/1995 | Bluemle | 229/68.1 |
| 5,598,969 | A * | 2/1997 | Ong | 229/67.1 |
| 6,109,511 | A * | 8/2000 | Schluger | 229/103.2 |
| 6,116,651 | A * | 9/2000 | Makofsky et al. | 281/29 |
| 6,193,147 | B1 * | 2/2001 | Schluger | 229/67.3 |
| 6,209,778 | B1 * | 4/2001 | Henrikson et al. | 229/67.1 |
| 6,666,610 | B1 * | 12/2003 | Moor et al. | 402/79 |
| 6,820,799 | B2 * | 11/2004 | Makofsky et al. | 229/68.1 |
| 7,306,134 | B1 * | 12/2007 | Ong | 229/67.1 |
| 2006/0016862 | A1 * | 1/2006 | Makofsky | 229/67.3 |

* cited by examiner

*Primary Examiner* — Jes F Pascua
(74) *Attorney, Agent, or Firm* — Francis C. Hand; Carella, Byrne, et al.

(57) ABSTRACT

The pocket folder has a closed pocket on the back section with each side of the closed pocket being freely expandable. Flaps that form the ends of the closed pocket are separated by a fold line into two contiguous parts that are hinged to each other to allow expansion of the pocket. The pocket folder is fabricated from a one-piece blank of any suitable material such as paper, paperboard or plastic and has score lines on at least the back section to permit expansion when materials are inserted into the closed pocket.

23 Claims, 4 Drawing Sheets

POCKET FOLDER AND BLANK FOR MAKING SAME

This invention relates to a pocket folder and to a blank for making the pocket folder.

As is known, various types of pocket folders have been constructed for the holding of sheets of paper and the like. One conventional folder is constructed with a pair of sections that are foldable along a vertical fold line to lay over each other. In addition, one or both sections is constructed with a pocket for receiving sheets of paper and the like. However, because of the nature of the construction of the folder sections, the pocket in each section has a rather limited capacity.

In order to increase the capacity of a pocket of a pocket folder, it has been known to construct the pocket folder as described in U.S. Pat. No. 6,116,651. As described therein, each section of the folder is provided with score lines in order to permit the sections to expand away from each other in order to enlarge the thickness of the pockets and thus the capacity of the pockets upon the insertion of materials. Each pocket is also provided with score lines to allow the front of the pocket to also expand upon the insertion of sheets of paper into the pocket.

However, the pockets of these expandable pocket folders have been open at one end. As a result, papers received in the pockets can slide sideways out of the pocket and loose sheets of pages may become dislodged from the pockets.

Accordingly, it is an object of the invention to provide an expandable pocket folder with a closed pocket that is able to retain sheets of paper in a secure manner.

It is another object of the invention to provide a simple blank for making an expandable pocket folder using a limited size of paper.

Briefly, the invention provides a one-piece blank for making a pocket folder that is provided with a closed pocket.

In one embodiment, the one-piece blank has a pair of contiguous rectangular sections that are to form the front and back of the pocket folder as well as an extension that extends from the bottom edge of one of the sections, a first flap that extends from the extension and second flap that extends from one of the rectangular sections. The extension and two flaps are to form the closed pocket.

At least the rectangular section of the blank that is to form the back of the pocket folder is provided with score lines that are spaced inwardly from each of the four edges as well as angularly disposed score lines that extend from an intersection of two of the score lines to a respective corner of the section.

The extension at the bottom edge of the section that is to form the back of the pocket folder is sized to fold over this section in order to form the face of a pocket. This extension has a horizontally disposed score line spaced from the bottom edge of the rectangular section, a vertically disposed score line spaced from a side edge and an angularly disposed score line extending from an intersection of the horizontally disposed score line and the vertically disposed score line of the extension to a respective corner of the extension. These score lines facilitate the expansion of the pocket when in use.

The flap that extends from the extension is sized to fold over the extension prior to the extension being folded over the rectangular section of the blank. This flap also has a vertically disposed score line intermediately thereof in order to separate the flap into a first part contiguous to the extension and a second part for folding flat against the rectangular section.

The second flap, i.e. the flap that extends from the rectangular section, is sized to fold over the rectangular section prior to folding of the extension over the rectangular section. This flap is thus located under the extension and has a vertically disposed score line intermediately thereof to separate the second flap into a first part contiguous to the rectangular section and a second part for folding flat against the extension.

The one piece blank may be cut from a single sheet of paper, such as a 16" by 22" piece of paper and thereafter die cut into the shape required to form a pocket folder. The blank may also be made of a paper board or card board or a plastic material, such as a vinyl plastic, that may be transparent or opaque.

In order to form a pocket folder, the second part of each flap is provided with a suitable adhesive or glue on an appropriate side so that when folded under the extension, each flap may be securely bound to the respective rectangular section and extension. Each of these flaps serves to close off a respective side of the pocket that is formed to thereby securely hold sheets of paper that are inserted into the pocket.

When an insert is inserted into and expands the closed pocket, the part of each flap that is not secured to either the back section or the extension pivots about the part that is secured to accommodate the expansion of the pocket, i.e. the expansion of the extension away from the back section.

In another embodiment, the one-piece blank for making a pocket folder may have the two flaps for forming the closed ends of the pocket formed on opposite sides of the extension. In this case, the two flaps would be folded over the extension prior to folding of the extension against the rectangular back section of the pocket folder. As above, a suitable adhesive or glue is provided on the outer parts of each flap in order to be bound to the rectangular section of the pocket folder.

This latter embodiment may also have a third rectangular section extending from an opposite side of the rectangular back section so that the pocket folder that is made from the blank is characterized in having a central section with a closed pocket and two side sections that fold over the central section.

The pocket folder made in accordance with the above embodiments may also be provided with either an open-ended conventional pocket on the second section that forms the front of the folder or with a closed pocket. In this latter case, the second rectangular section is provided with an extension having a horizontally disposed score line spaced from the bottom edge of the rectangular section while a flap extends from the rectangular section for folding under this second extension with this second extension folded over the rectangular section. As above, the flap is provided with a vertically disposed score line to separate the flap into a first part contiguous to the rectangular section and a second part for folding flat against the second extension and for receiving an adhesive or glue to be bound to the second extension.

The pocket folder may be provided with additional features, such as a small transparent pocket on the face of the front section to receive an insert that is personalized to the user. For example, the insert may be a business card. The pocket folder whether of two-fold or three-fold type may have a transparent pouch secured to the front face that is of the same size as the front face to receive an insert that contains information, printed or otherwise, regarding the contents of the pocket folder or regarding any other matter germane to the pocket folder, such as a case file, owner, and the like. Also, where the pocket folder is made of a transparent plastic, e.g. to permit viewing of the contents of the folder, an opaque insert may be laminated onto the back section or slipped into a pouch on the back section to obstruct viewing of the contents from the back or for aesthetic reasons.

These and other objects and advantages of the invention will become more apparent from the following detailed description taken in conjunction with the accompanying drawings wherein.

Figure 1:
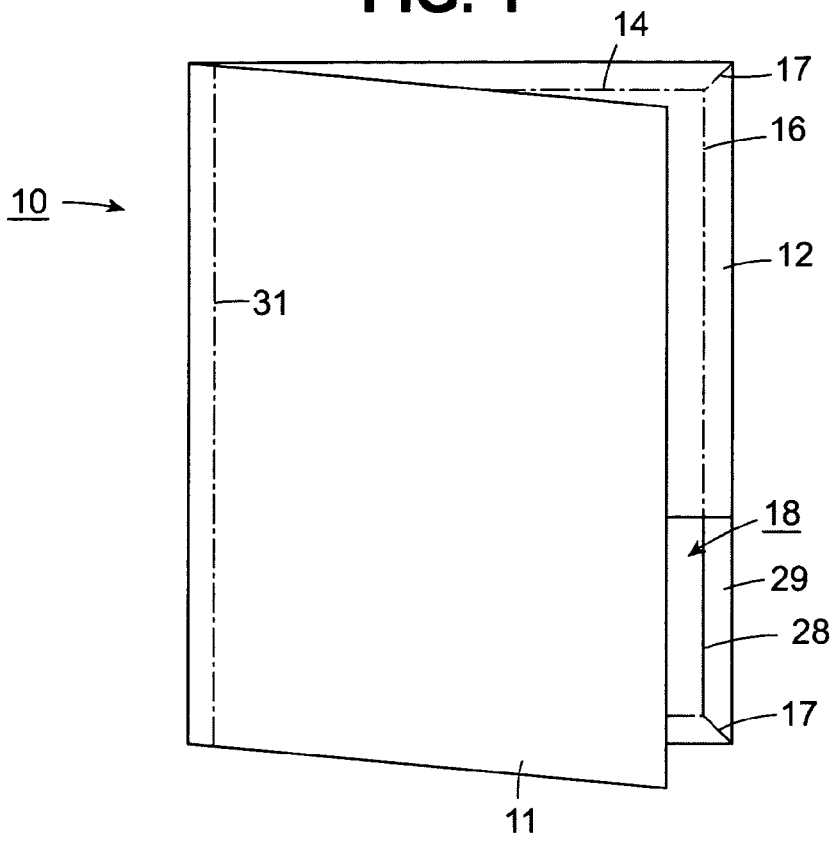
FIG. 1 illustrates a perspective view of a partially open pocket folder constructed in accordance with the invention.
Figure 2:
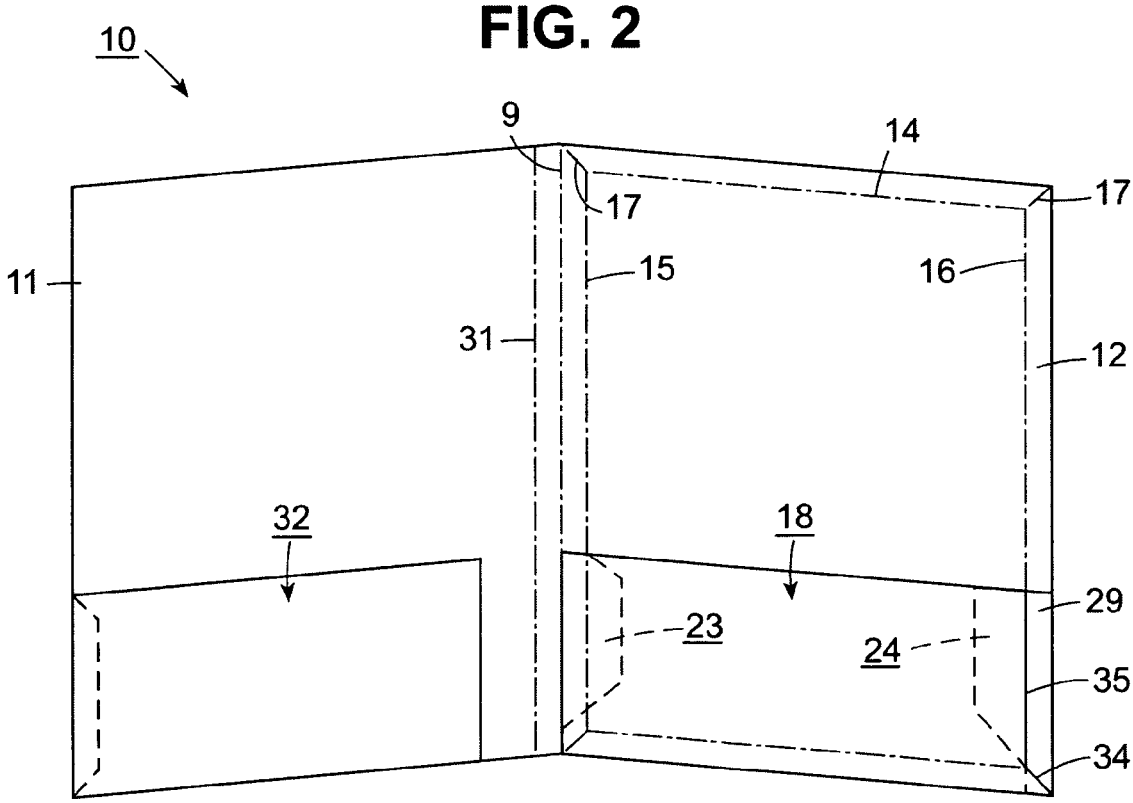
FIG. 2 illustrates a view of the pocket folder of FIG. 1 in an opened condition.

Referring to FIG. 1, the pocket folder 10 is comprised of a pair of contiguous rectangular sections 11,12 that form the respective front and back of the pocket folder 10 and that are folded over each other about a central fold line 9 (see FIG. 2).

Referring to FIGS. 1 and 2, the back section 12 has a horizontally disposed score line 13 spaced from a bottom edge thereof, a horizontally disposed score line 14 spaced from a top edge thereof, a vertically disposed score line 15 spaced from one side edge thereof, a vertically disposed score line 16 spaced from another side edge thereof and a plurality of angularly disposed score lines 17, each of which extends from an intersection of a respective horizontally disposed score line 13,14 and a vertically disposed score line 15,16 to a respective corner of the section.

The pocket folder 10 has a pocket 18 formed on the back section 12 to receive sheets of material, pads, magazines or other similar types of inserts (not shown).

Figure 3:
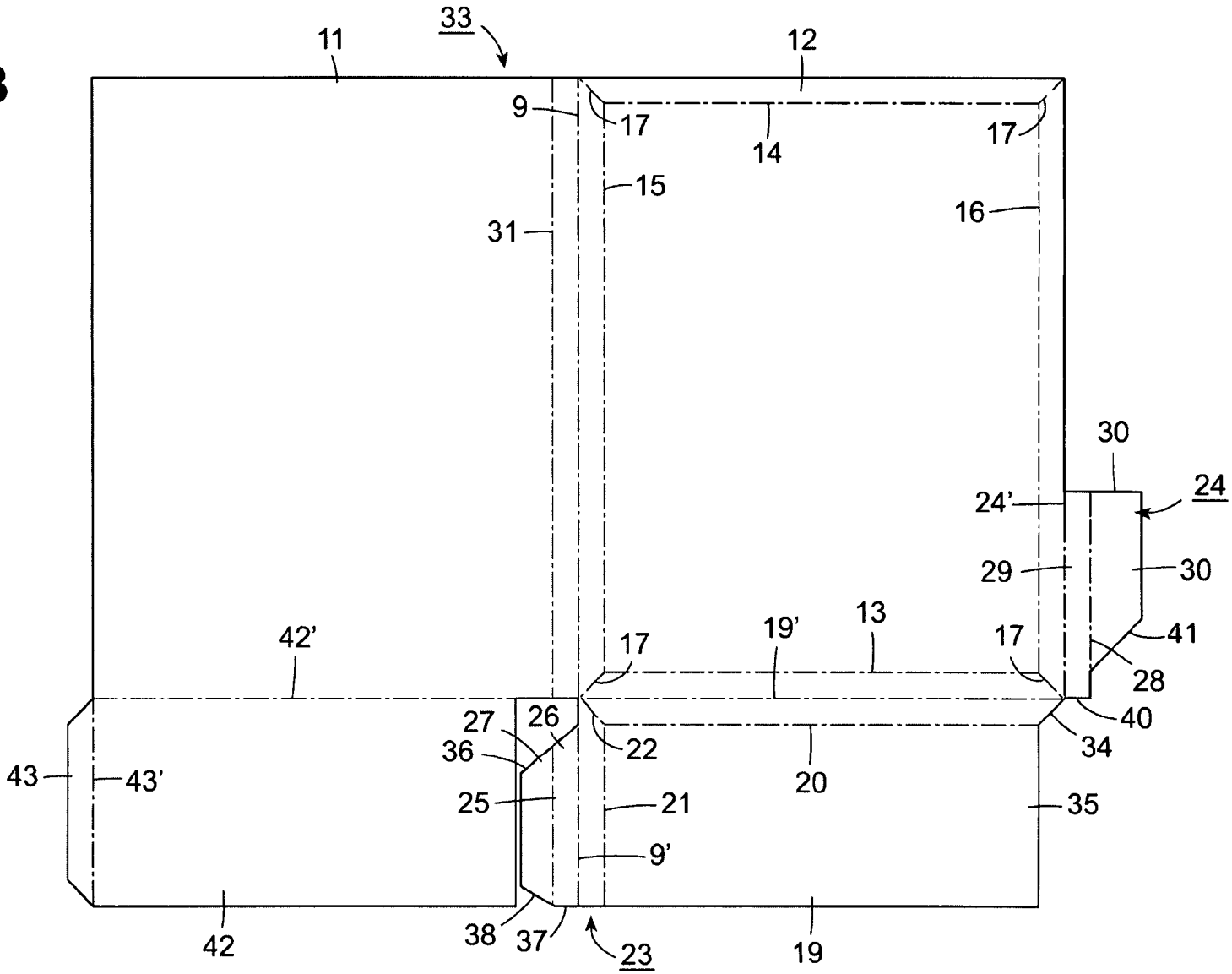
FIG. 3 illustrates a view of a blank used to make the pocket folder of FIG. 1.

Referring to FIG. 3, the pocket 18 is formed by a panel 19 that extends from the bottom edge of the back section 12 along a fold line 19' as an extension and that is folded over the back section 12. The panel 19 has a horizontally disposed score line 20 spaced from the bottom edge, a vertically disposed score line 21 spaced from a side edge and an angularly disposed score line 22 extending from an intersection of the horizontally disposed score line 20 and the vertically disposed score line 21 to a corner of the panel. The horizontal score line 20 and vertical score line 21 of the panel as well as the angularly disposed score line 22 overlie and are coincident with the horizontal score line 13 and vertical score line 15 of the back section 12 and the angularly disposed score line 17.

The pocket 18 is further formed by a pair of flaps 23, 24 that serve to close the pocket 18 at opposite sides and thus prevent materials inserted into the pocket 18 from sliding laterally out of the pocket 18.

One flap 23 extends from the panel 19 along an extension 9' of the center fold line 9 and is folded under the panel 19. This flap 23 has a vertically disposed score line 25 intermediately thereof to separate the flap 23 into a first part 26 contiguous to and extending from the panel 19 and a second part 27 folded flat against and secured to the back section 12. The score line 25 is coincident with the vertical score line 15 of the back section 12 and the vertical score line 21 of the panel 19. The second part 27 of the flap 23 is secured by a suitable adhesive or glue to the back section 12 while the first part 26 is free to move relative to the back section 12 when materials are inserted into the pocket 18.

The second flap 24 extends from the back section 12 along a fold line 24' that is coincident with the edge of the back section 12 and is folded under the panel 19. This second flap 24 has a vertically disposed score line 28 intermediately thereof to separate the flap 24 into a first part 29 contiguous to the back section 12 and a second part 30 folded flat against and secured to the underside of the panel 19. The vertical score line 29 is coincident with the right-hand edge, as viewed, of the panel 19 and the vertical score line 16 of the back section 12. The second part 30 of the flap 24 is secured by a suitable adhesive or glue to the underside of the panel 19 while the first part 29 is free to move relative to the back section 12 when materials are inserted into the pocket 18.

The front section 11 of the pocket folder 10 is provided with a vertically disposed score line 31 spaced from the side edge contiguous to the back section 12 and extends over the height of the front section 11 to allow expansion of the front section 11 over the materials inserted into the pocket 18 of the back section 12.

The front section 11 may also be provided with an open-ended pocket 32 of conventional construction.

Referring to FIG. 3, wherein like reference characters indicate like parts as above, the one piece blank 33 for making the pocket folder 10 comprises the pair of contiguous rectangular sections 11,12 with the various score lines 13,14,15,16, 17, 31 therein.

The blank 33 also includes the extension 19 that is contiguous to and that extends from the bottom of the back section 12; the first flap 23 that is contiguous to and that extends laterally from the extension 19 for folding over the extension 19; and the second flap 24 that extends from the back section 12 for folding under the extension 19. The extension 19 and flaps 23, 24 are provided with the respective score lines 20, 21, 22, 25, 28.

The extension 19 is of the same width as the back section 12 along the adjoining edges but is die cut along the right-hand side, as viewed, to provide a reduced width. As shown, the extension 19 has an angled edge 34 that is to overlie and be coincident with the angled score line 17 in the back section 12. The extension 19 also has a straight edge 35 along the right-hand side to overlie and be coincident with the vertical score line 16 in the back section 12.

The flap 23 is of lesser height than the extension 19 so that when folded over and secured to the back section 12 (See FIG. 2), the flap 23 does not interfere with the expansion of the pocket 18. The flap 23 is also die cut to have an angled edge 36 at the upper end, as viewed in FIG. 3, that is parallel to the angled score line 22 when the flap 23 is folded over the extension 19 (See FIG. 2). The flap 23 also has a straight lower edge 37 that is an extension of the lower edge of the extension 19 and an angled edge 38 that extends from the straight lower edge 37. The outer part 27 of the flap 23 is thus of a trapezoidal shape and provides a substantial sealing area to receive an adhesive or a glue for securing the flap 23 to the back section 12.

As shown in FIG. 3, the flap 23 is slightly spaced from the panel 42 that forms the open pocket 32 in the front section 11.

The flap 24 has a straight upper edge 39 that is to be coincident with the straight upper edge of the panel 19, a straight lower edge 40 that is spaced slightly above, e.g. by about 1/16 inch, the fold line 19' of the back section 12 and an angled lower edge 41 that is to overlie and be coincident with an angled score line 17 in the back section 12.

As illustrated in FIG. 2, the part 29 of the flap 24 that is contiguous to the back section 12 is of rectangular shape and has a lower end that lies under a corner of the extension 19 when the extension is folded over the back section 12 so as to seal the corner of the closed pocket 18. The outer part 30 of the flap 24 is of a shape to provide a substantial sealing area to receive an adhesive or a glue for securing the flap 24 to the extension 19.

The blank 33 also includes an extension 42 that is contiguous to and that extends from the bottom of the front section 11 along a fold line 42' and a flap 43 that is contiguous to and that extends laterally from the extension 42 for folding along a fold line 43' under the extension 42 to form the open-ended pocket 32 (see FIG. 2). The flap 43 is provided with a suitable glue or adhesive to be secured to the front section 11 when the pocket folder is fabricated.

In order to form the blank 33 into the pocket folder 10, a suitable adhesive or glue is applied to the underside of the outer parts 27, 30 of the flaps 23, 24 as well as to the underside of the flap 43.

Thereafter, the flap 23 is folded over the extension (panel) 19; the flap 24 is folded over the back section 12 and the flap 43 is folded over the extension (panel) 42.

Next, the extension 19 is folded over the back section 12 along the fold line 19' so that the outer part 27 of the flap becomes adhesively secured to the back section and so that the outer part of 30 of the flap 24 becomes secured to the back side of the extension 19. The two flaps 23, 24 thus serve to close the pocket 18 (see FIG. 2) at each lateral side.

During the folding operation, the extension 42 is also folded against the front section 11 so that the flap 43 adheres to the front section 11 to form an open pocket.

When materials are inserted into the closed pocket 18, the score lines 25, 28 of the respective flaps 23, 24 and the fold lines 9', 24' between the flaps 23,24 and the respective extension 19 and back section 12 allow the parts 26,29 of the respective flaps 23,24 to pivot thereby allowing the pocket 18 to expand without restraint.

The blank 33 may be formed by a single sheet of paper, paperboard, cardboard, plastic or any other suitable material of rectangular shape, which is die cut to give the appearance as shown in FIG. 3. For example, the blank 33 may be die cut from a piece of material having a width of 22 inch and a length of 16 inches. When folded, the blank 33 may form a pocket folder 10 having a width of 9½ inches, a height of 12 inches and a pocket 18 of 4 inch height.

In those instances where one wishes to avoid the appearance of score lines in the back section of the pocket folder, the blank 33 may be modified by eliminating the horizontal score lines 13,14, the vertical score line 16 at the right hand side, as viewed, and the four diagonal score lines 17. The vertical score line 15 would remain and be extended to the top and bottom edges to mirror the score line 31 in the front section 11.

Figure 5:
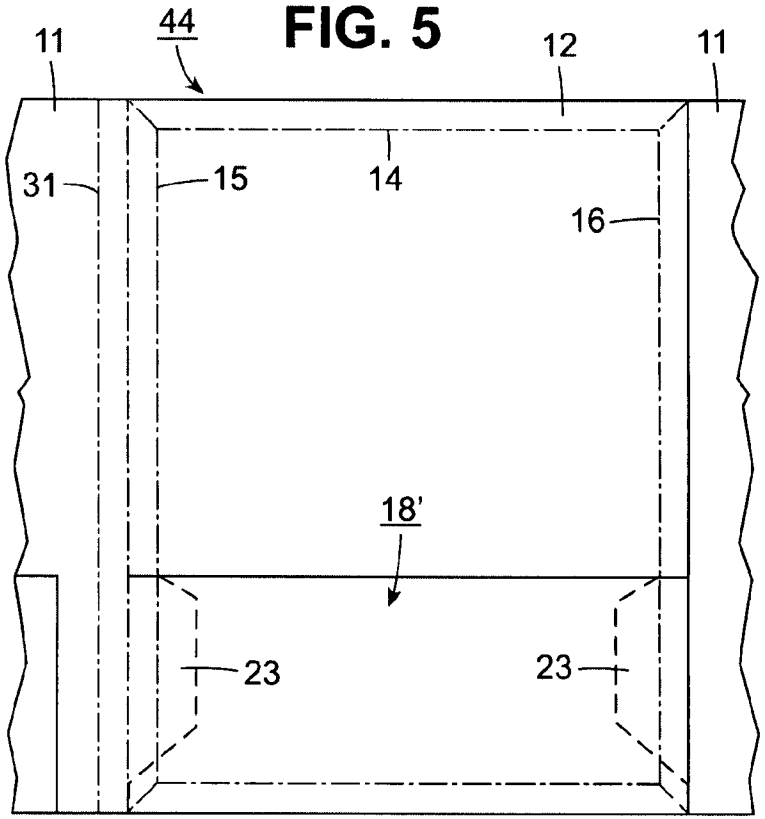
FIG. 5 illustrates a view of a pocket folder made with the blank of FIG. 4.
Figure 4:
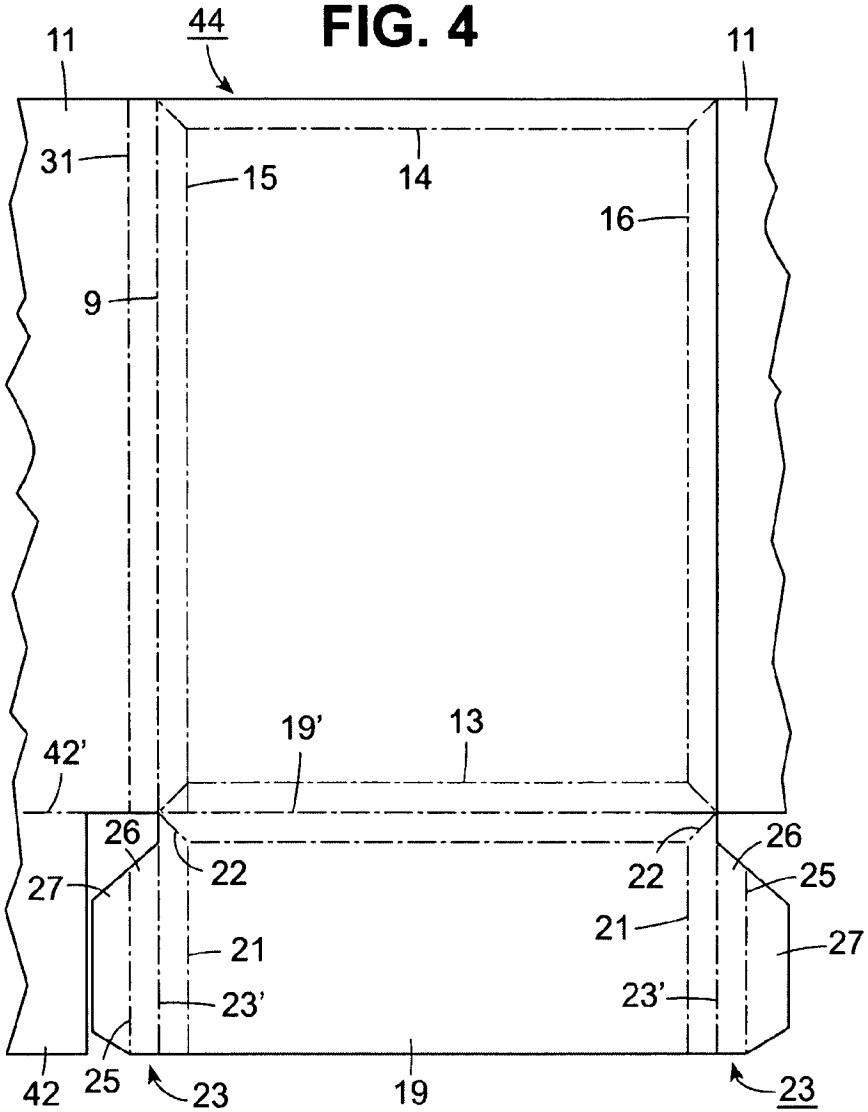
FIG. 4 illustrates a modified blank for making a pocket folder in accordance with the invention.

Referring to FIGS. 4 and 5, wherein like reference characters indicate like parts as above, the blank 44 has three rectangular sections 11, 12 with the central section 12 forming the back section of the folder 10' to be made. In this embodiment, the blank 44 is symmetrical about a vertical center line of the back section 12. The outer two sections 11 are foldable over the central section 12.

Referring to FIG. 5, the folder 10' is made with a closed pocket 18' that is made of symmetrical construction. In this embodiment, as shown in FIG. 4, the panel 19 that extends from the bottom edge of the back section 12 as an extension has a pair of flaps 23 at opposite ends. As above, each flap 23 is separated from the extension 19 via a fold line 23' along the respective edge of the extension so as to be readily folded over the extension during fabrication of the pocket folder 10'. Also, each flap 23 has a vertically disposed score line 25 at an intermediate point to separate the flap 23 into a first part 26 contiguous to and extending from the panel 19 and a second part 27 to be folded flat against and secured to the back section 12. The score line 25 is coincident with a vertical score line 15-16 in the back section 12.

In addition, the panel 19 is provided with a pair of vertical score lines 21, each coincident with a vertical score line 15, 16 in the back section 12. The panel 19 also has a horizontally disposed score line 20 as above and diagonally disposed score lines 22 on each side.

In order to form the blank 44 into the pocket folder 10', a suitable adhesive or glue is applied to the underside of the outer parts 27 of the flaps 23. Thereafter, each flap 23 is folded over the panel 19. Next, the panel 19 is folded over the back section 12 so that the outer part 27 of each flap 23 becomes adhesively secured to the back section 12. The two flaps 23 thus serve to close the pocket 18' (see FIG. 5) at each lateral side. The extensions 46 of the outer sections 11 are also folded and adhered, as above. The two outer sections 11 may then be folded over the central section 12.

It is to be noted that the inner part 26 of each flap is not secured to the back section 12. Thus, when an insert is stuffed into the pocket 18', the panel is able to move away from the back section 12. At the same time, the inner part 26 of each flap 23 pivots away from the back section 12 and does not restrain movement of the panel 19 away from the back section 12 to accommodate the thickness of the insert.

Each outer section 11 is provided with an extension 46, as above, to form an open pocket 32.

In another embodiment, the right-hand section 11 of the pocket folder 10' may be omitted in fabrication. In this case, the pocket folder similar to the pocket folder shown in FIG. 1.

Figure 6:
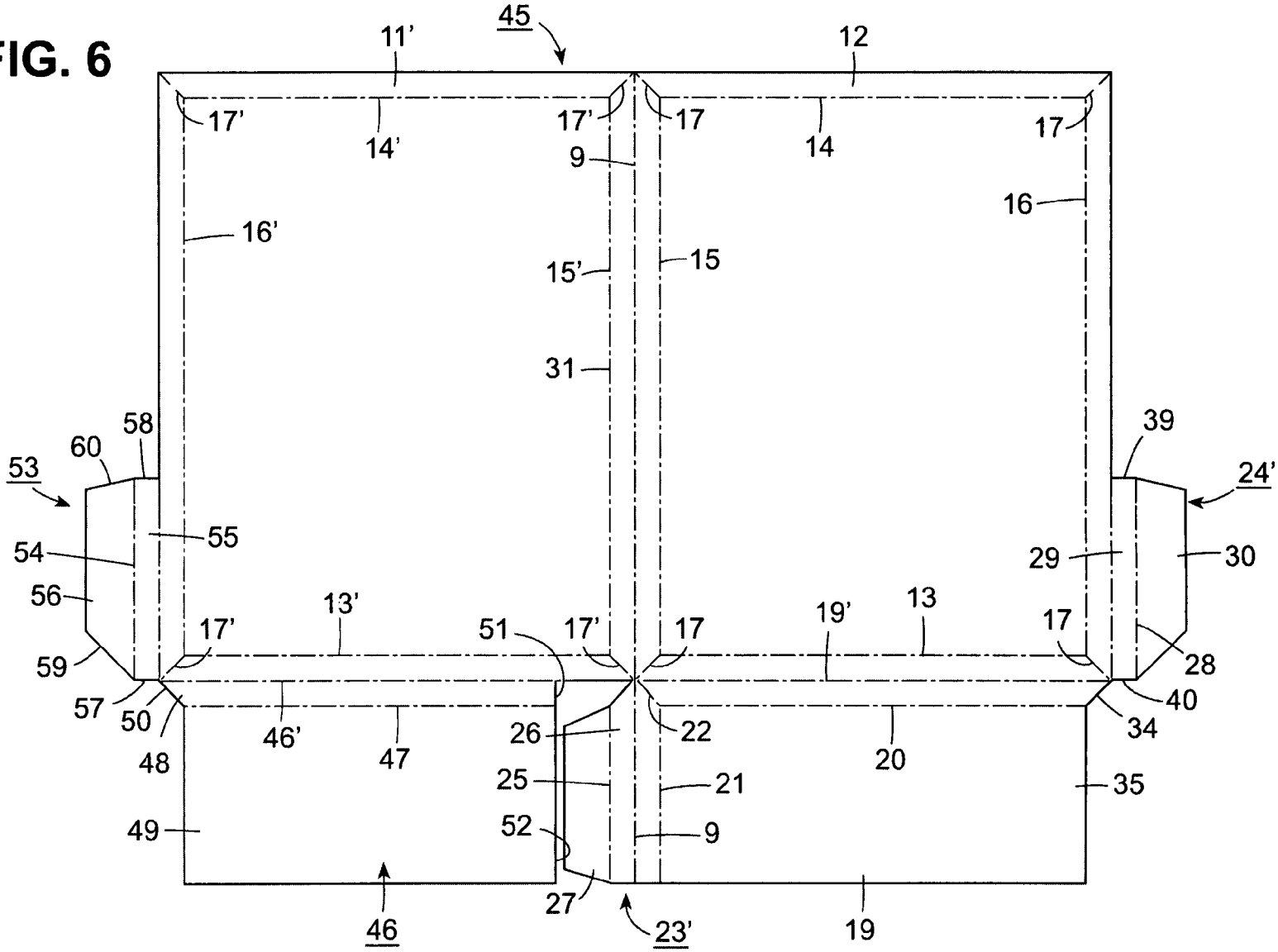
FIG. 6 illustrates a view of a further blank for making a pocket folder in accordance with the invention.

Referring to FIG. 6, wherein like reference characters indicate like parts as above, the blank 45 has a back section 12 as above and a front section 11' provided with score lines 13', 14', 15', 16' as on the back section 12.

As shown, the flap 23' extending from the extension 19 is die cut so that the outer part 27 is of a larger area than in the embodiment of FIG. 3 to provide additional surface area to receive an adhesive or a glue. Also, inner part 26 is of the same height as the extension 19 and has an upper edge 26' that is angled to overlie and be coincident with the angular score line 22 on the extension 19.

The flap 24' that extends from the back section 12 is die cut so that the inner part 29 has an upper edge 39 that is to be coincident with the upper edge of the pocket to be formed while the outer part 30' has an upper edge 39' that is angled downwardly.

In addition, the blank 45 also includes an extension 46 that is contiguous to and that extends from the bottom of the front section 11 via a fold line 46'. This extension 46 includes a horizontal score line 47 that is coincident with the score line 20 on the panel 19 that extends from the back section 12. The score line 47 divides the extension 46 into an inner part 48 contiguous to the front section 11 and a rectangular part 49 that is to form the front face of a pocket on the front section 11.

As illustrated, the inner part 48 has a chamfered edge 50 on the left-hand side as viewed. The right-hand side of the part 48 has an edge 51 coincident with the edge 52 of the outer part 49. These edges 51, 52 are spaced from the outer part 27 of the flap 23 of the panel 19 that forms the pocket on the back section 12.

The edge 50 of the inner part 48 extends from a corner of the front section 11 at an angle of 45 degrees.

The blank 45 also has a flap 53 that extends from the front section 11 to be folded under the extension 46. This flap 53 has a vertically disposed score line 54 at an intermediate point to separate the flap 53 into a first part 55 contiguous to the back section and a second part 56 to be folded flat against the underside of the extension 46. The score line 54 is spaced from the edge of the front section 11 the same distance as the fold line 16' to be coincident therewith when the flap 53 is folded over the front section 11.

As viewed, the inner part 55 is of rectangular shape and has a lower edge 57 that is spaced vertically from the bottom edge of the front section 11 and fold line 46' by a small amount, e.g. by about 1/16 inch, to facilitate a clean folding over of the flap 53 over the front section 11. The upper edge 58 extends perpendicularly from the front section 11 so as to be coincident with the upper edge of the pocket when the pocket is formed.

The outer part 56 of the flap 53 has a chamfered edge 59, 60 at each end. As shown, the lower edge 59 is at a greater angle to the horizontal than the upper edge 60. Further the upper edge 60 is angled downwardly from a horizontal plane so that when the pocket folder is made, the edge 60 does not project out of the pocket should the folding up of the extension 46 not be accomplished accurately.

In order to form a pocket folder from the blank 45, a suitable adhesive or glue is applied to the flaps 23, 24 and folding is performed on the extension 19 and flaps 23, 24 as described above. This sequence of steps forms the closed pocket on the back section 12. In order to form the pocket on the front section 11, the adhesive is applied to the underside of outer part 56 of the flap 53 and the flap 53 folded over the front section 11. Thereafter, the extension 46 is folded over the flap 53 and the front section 11 so that the outer part 56 of the flap 53 becomes secured to the extension 46 thereby forming a closed end of the resulted pocket. The opposite end of the pocket remains opened.

As above, when an insert is inserted into the open pocket on the front section 11, the inner part 55 of the flap is able to pivot about the outer edge of the front section 11 without restraining expansion of the extension 46 away from the front section 11. The flap 53 thus serves as a hinge to allow the expansion of the pocket.

The invention thus provides a blank that can be made with a minimum of material in order to form an expandable closed pocket for receiving inserts in a secure manner.

The invention further provides a pocket folder of expandable nature with a closed pocket for receiving inserts.

What is claimed is:

1. A one piece blank for a pocket folder comprising at least pair of contiguous rectangular sections;

a first extension contiguous to and extending from a horizontal bottom edge of one of said sections for folding over said one section, said extension having a horizontally disposed score line spaced from said bottom edge of said one section, a vertically disposed score line spaced from a side edge thereof and an angularly disposed score line extending from an intersection of said horizontally disposed score line and said vertically disposed score line of said extension to a respective corner of said extension;

a first flap contiguous to and extending from said extension for folding under said extension with said extension folded over said one section, said flap having a vertically disposed score line intermediately thereof to separate said flap into a first part contiguous to said extension and a second part for folding flat against said one section; and a second flap extending from said one section for folding under said extension with said extension folded over said one section, said second flap having a vertically disposed score line intermediately thereof to separate said second flap into a first part contiguous to said one section and a second part for folding flat against said extension.

2. A one piece blank as set forth in claim 1 wherein said one section has a horizontally disposed score line spaced from said bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective corner of said section.

3. A one piece blank as set forth in claim 1 wherein the other section of said pair of sections has a vertically disposed score line spaced from a side edge thereof contiguous to said one section and extending over the height of said other section.

4. A one piece blank as set forth in claim 1 further comprising a second extension contiguous to and extending from said bottom edge of the other of said sections for folding over said other section and a third flap extending from said other of said sections for folding under said second extension with said second extension folded over said other section.

5. A one piece blank as set forth in claim 1 wherein the other section of said pair of sections has a horizontally disposed score line spaced from a bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective corner of said section.

6. A one piece blank as set forth in claim 5 further comprising a second extension contiguous to and extending from said bottom edge of the other of said sections for folding over said other section, said extension having a horizontally disposed score line spaced from said bottom edge of said other of said sections, and a third flap extending from said other of said sections for folding under said second extension with said second extension folded over said other section, said third flap having a vertically disposed score line intermediately thereof to separate said third flap into a first part contiguous to said other section and a second part for folding flat against said second extension.

7. A one piece blank as set forth in claim 1 wherein each said rectangular section has a horizontally disposed score line spaced from a bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective corner of said section.

8. A one piece blank as set forth in claim 1 further comprising a second extension contiguous to and extending from said bottom edge of the other of said sections for folding over said other section, said extension having a horizontally disposed score line spaced from said bottom edge of said other of said sections, and a third flap extending from said other of said sections for folding under said second extension with said second extension folded over said other section, said third flap having a vertically disposed score line intermediately thereof to separate said third flap into a first part contiguous to said other section and a second part for folding flat against said second extension.

9. A one piece blank for a pocket folder comprising at least a pair of contiguous rectangular sections;

a first extension contiguous to and extending from a bottom edge of one of said sections for folding over said one section, said extension having a horizontally disposed score line spaced from said bottom edge of said one section, a vertically disposed score line spaced from a side edge thereof and an angularly disposed score line extending from an intersection of said horizontally disposed score line and said vertically disposed score line of said extension to a respective corner of said extension;

a first flap extending from one side of said extension for folding under said extension with said extension folded over said one section, said flap having a vertically disposed score line intermediately thereof to separate said flap into a first part contiguous to said extension and a second part for folding flat against said one section; and a second flap extending from an opposite side of said extension for folding under said extension with said extension folded over said one section, said second flap having a vertically disposed score line intermediately thereof to separate said second flap into a first part contiguous to said one section and a second part for folding flat against said one section.

10. A one piece blank as set forth in claim 9 wherein at least said one section has a horizontally disposed score line spaced from a bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective corner of said section.

11. A pocket folder comprising at least a pair of contiguous rectangular sections;

a first extension extending from a bottom edge of one of said sections and folded over said one section to define a pocket, said extension having a horizontally disposed score line spaced from said bottom edge of said one section, a vertically disposed score line spaced from a side edge thereof and an angularly disposed score line extending from an intersection of said horizontally disposed score line and said vertically disposed score line of said extension to a respective corner of said extension;

a first flap extending from said extension and folded under said extension with said extension folded over said one section, said flap having a vertically disposed score line intermediately thereof to separate said flap into a first part contiguous to said extension and a second part folded flat against and secured to said one section; and a second flap extending from said one section and folded under said extension with said extension folded over said one section, said second flap having a vertically disposed score line intermediately thereof to separate said second flap into a first part contiguous to said one section and a second part folded flat against and secured to said extension.

12. A pocket folder as set forth in claim 11 wherein at least one of said rectangular sections has a horizontally disposed score line spaced from a bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective corner of said section.

13. A pocket folder as set forth in claim 11 wherein the other section of said pair of sections has a vertically disposed score line spaced from side edge thereof contiguous to said one section and extending over the height of said other section.

14. A pocket folder as set forth in claim 11 further comprising a second extension extending from said bottom edge of the other of said sections and folded over said other section and a third flap extending from said other of said sections and folded under said second extension with said second extension folded over said other section.

15. A pocket folder comprising at least a pair of contiguous rectangular sections;

a first extension extending from a bottom edge of one of said sections and folded over said one section to define a pocket, said extension having a horizontally disposed score line spaced from said bottom edge of said one section, a vertically disposed score line spaced from each side edge thereof and an angularly disposed score line extending from an intersection of said horizontally disposed score line and each said vertically disposed score line of said extension to a respective corner of said extension: and a pair of flaps extending from opposite sides of said extension, each said flap being folded under said extension with said extension folded over said one section, each said flap having a vertically disposed score line intermediately thereof to separate said flap into a first part contiguous to said extension and a second part folded flat against and secured to said one section.

16. A pocket folder as set forth in claim 15 wherein at least one of said rectangular sections has a horizontally disposed score line spaced from a bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective corner of said section.

17. A pocket folder as set forth in claim 15 wherein the other section of said pair of sections has a vertically disposed score line spaced from side edge thereof contiguous to said one section and extending over the height of said other section.

18. A pocket folder comprising a back section having a horizontally disposed score line spaced from a bottom edge thereof, a vertically disposed score line spaced from one side edge thereof, a vertically disposed score line spaced from another side edge thereof and a plurality of angularly disposed score lines, each said angularly disposed score line extending from an intersection of said horizontally disposed score line and a vertically disposed score line towards a respective corner of said ply;

a panel extending from said bottom edge of said back section and folded over said back section to define a pocket therewith;

a first flap extending from said panel and folded under said panel with said panel folded over said back section, said flap having a vertically disposed score line intermediately thereof to separate said flap into a first part contiguous to said panel and a second part folded flat against and secured to said back section; and a second flap extending from said back section and folded under said panel with said panel folded over said back section, said second flap having a vertically disposed score line intermediately thereof to separate said second flap into a first part contiguous to said back section and a second part folded flat against and secured to said panel.

19. A pocket folder comprising a back section having a horizontally disposed score line spaced from a bottom edge thereof, a vertically disposed score line spaced from one side edge thereof, a vertically disposed score line spaced from another side edge thereof and a plurality of angularly disposed score lines, each said angularly disposed score line extending from an intersection of said horizontally disposed score line and a vertically disposed score line towards a respective corner of said back section;

a panel extending from said bottom edge of said back section and folded over said back section, said panel having a horizontal score line coincident with said horizontally disposed score line of said back section, a vertically disposed score line spaced from a side edge thereof and an angularly disposed score line extending from an intersection of said horizontally disposed score line and said vertically disposed score line of said panel to a respective corner of said panel; and a flap extending from said back section, said flap having a vertically disposed score line intermediately thereof to separate said flap into a first part contiguous to said back section and a second part folded flat against and secured to said panel.

20. A pocket folder as set forth in claim 19 wherein said score line of said flap is coincident with a respective vertical score line of said back section and said panel is of less width than said back section with a vertical edge coincident with said score line of said flap and with a vertical edge on a side opposite said flap spaced from a vertical edge of said back section to form an open pocket.

21. A pocket folder as set forth in claim 19 wherein said flap is folded under said panel with said panel folded over said back section.

22. A one piece blank for a pocket folder comprising at least pair of contiguous rectangular sections;

a first extension contiguous to and extending from a horizontal bottom edge of one of said sections for folding over said one section, said extension having a horizontally disposed score line spaced from said bottom edge of said one section, a vertically disposed score line spaced from a side edge thereof and an angularly disposed score line extending from an intersection of said horizontally disposed: score line and said vertically disposed score line of said extension to a respective corner of said extension;

a first flap contiguous to and extending from said extension for folding relative to said extension with said extension folded over said one section, said flap having a vertically disposed score line intermediately thereof to separate said flap into a first part contiguous to said extension and a second part for folding flat relative to said one section; and a second flap extending from said one section for folding relative to said extension with said extension folded over said one section, said second flap having a vertically disposed score line intermediately thereof to separate said second flap into a first part contiguous to said one section and a second part for folding flat relative to said extension.

23. A one piece blank for a pocket folder comprising at least a pair of contiguous rectangular sections;

a first extension contiguous to and extending from a bottom edge of one of said sections for folding over said one section, said extension having a horizontally disposed score line spaced from said bottom edge of said one section, a vertically disposed score line spaced from a side edge thereof and an angularly disposed score line extending from an intersection of said horizontally disposed score line and said vertically disposed score line of said extension to a respective corner of said extension;

a first flap extending from one side of said extension for folding relative to said extension with said extension folded over said one section, said flap having a vertically disposed, score line intermediately thereof to separate said flap into a first part contiguous to said extension and a second part for folding flat relative to said one section; and a second flap extending from an opposite side of said extension for folding relative to said extension with said extension folded over said one section, said second flap having a vertically disposed score line intermediately thereof to separate said second flap into a first part contiguous to said one section and a second part for folding flat relative to said one section.

* * * * *